US007204306B2

(12) United States Patent
Abdrakhmanov et al.

(10) Patent No.: US 7,204,306 B2
(45) Date of Patent: Apr. 17, 2007

(54) DEVICE FOR INSTALLATION OF A PROFILE LINER IN A WELL

(75) Inventors: Gabdrashit Sultanovich Abdrakhmanov, Bugulma (RU); Khamit Zagirovich Kaveev, Almetievsk (RU); Ravil Rustamovich Ibatullin, Bugulma (RU); Izil Galimzyanovich Jusupov, Bugulma (RU); Nigamatian Khamitovich Khamitianov, Bugulma (RU); Anatoly Veniaminovich Kirshin, Bugulma (RU); Albert Salavatovich Yagafarov, Bugulma (RU); Ruslan Gabdrashitovich Abdrakhmanov, Moscow (RU); Leonid Vladimirovich Junyshev, Ekaterinburg (RU); Nail Nazymovich Vildanov, Bugulma (RU)

(73) Assignee: Otkrytoe Aktsionernoe Obschestvo "Tatneft" IM. V.D. Shashina, Tatarstan (RU)

( * ) Notice: Subject to any disclaimer, the term of this patent is extended or adjusted under 35 U.S.C. 154(b) by 0 days.

(21) Appl. No.: 11/324,165

(22) Filed: Dec. 30, 2005

(65) Prior Publication Data

US 2006/0175055 A1 Aug. 10, 2006

Related U.S. Application Data

(63) Continuation of application No. PCT/RU2004/000152, filed on Apr. 22, 2004.

(30) Foreign Application Priority Data

Jun. 30, 2003 (RU) ..... 2003119833

(51) Int. Cl.
*E21B 43/10* (2006.01)

(52) U.S. Cl. ..... 166/207; 166/206; 166/382; 166/384

(58) Field of Classification Search ..... 166/206, 166/207, 382, 384
See application file for complete search history.

(56) References Cited

U.S. PATENT DOCUMENTS 2,627,891 A * 2/1953 Clark ..... 72/119

(Continued)

FOREIGN PATENT DOCUMENTS

GB 2382605 A 6/2003

(Continued)

OTHER PUBLICATIONS

Partial English translation of RU 215148C2.

(Continued)

*Primary Examiner*—David Bagnell
*Assistant Examiner*—G M Collins
(74) *Attorney, Agent, or Firm*—Ladas and Parry LLP

(57) ABSTRACT

A device for expansion and calibration of profile pipes, such as profile liners, with cylindrical threaded ends in their installation in a well. The device has a plurality of in-series connected mandrel assemblies, each of which has a housing with a central straight-through channel and inclined slots, in which rains are fastened and hinge-connected through pushers, tightened with respect to the housing, with a spring-loaded rod, accommodated in the central straight-through channel of the housing. Rods of an upper mandrel assembly are spring-loaded for holding the rams in nonoperating position, and rods of a lower assembly are spring-loaded for holding the rams in operating position. The lower mandrel assembly is provided with a choke. The Maximum diameter of a circle circumscribed about each mandrel assembly in its working position decreases from the upper assembly to the lower one.

10 Claims, 2 Drawing Sheets

U.S. PATENT DOCUMENTS

| | | | | |
|---|---|---|---|---|
| 5,014,779 | A | 5/1991 | Meling et al. | |
| 6,457,532 | B1 * | 10/2002 | Simpson | 166/380 |
| 2005/0022986 | A1 * | 2/2005 | Ring et al. | 166/208 |

FOREIGN PATENT DOCUMENTS

| | | | |
|---|---|---|---|
| RU | 215148 | C2 | 8/2000 |
| RU | 2194841 | C2 | 12/2002 |
| SU | 607950 | A | 5/1978 |
| SU | 1432190 | A1 | 10/1988 |
| SU | 1747673 | A1 | 7/1992 |

OTHER PUBLICATIONS

Partial English translation of RU 2194841C2.
Partial English translation of SU 1432190 A1.
Partial English translation of SU 607950 A.
Partial English translation of SU 1747673 A1.

* cited by examiner

DEVICE FOR INSTALLATION OF A PROFILE LINER IN A WELL

This application is a continuation of copending International Application PCT/RU2004/000152 filed on Apr. 22, 2004, which designated the U.S., claims the benefit thereof and incorporates the same by reference.

FIELD OF THE INVENTION

The invention relates to well drilling and workover and is designed, in particular, for expansion and calibration of profile pipes with cylindrical threaded ends, such as profile liners, in their installation in wells.

BACKGROUND OF THE INVENTION

There is known a device for expanding profile pipes in their installation in wells, comprising a conical housing with a central channel, connecting threads and multi-step recesses in a wall, in which rollers with spherical surface are installed and arranged uniformly on axes along circumference of the housing. And the rollers in recesses are mounted perpendicular to longitudinal geometric axis of the housing, and in between them the rams with spherical surface are mounted, where rams of each subsequent stage are placed under the rollers of the previous one (Patent of Russian Federation No 2194841, E21B 29, October 2002).

A drawback of the known device is a low quality of profile pipes expanding, since profile of threaded connections after expanding by each section of the device takes a triangular sectional view. As a result, loss of sealing of threaded connections occurs.

The most close to the invention by technical essence is a device for expanding profile pipes in their installation in wells, comprising a housing with a central channel and three mandrel components, one of which is made in the form of rams, fastened in inclined slots of the housing and spring-loaded away from their extension into working position (Patent of Russian Federation No 2154148, E21B 29, October 2000).

Main drawbacks of this device are low serviceability and reliability in its operation in the open borehole under clay mud presence in it and possible sloughing of rocks, which result in sticking and jamming of mandrel components, especially in the upper part of the device.

SUMMARY OF THE INVENTION

Object of the invention—the increase of serviceability and reliability of the device in expanding profile pipes with cylindrical ends, such as profile liners.

This is attained by being described device for installation of profile liners in a well, which device according to the invention is made in the form of several in-series connected mandrel assemblies each of them includes:

a housing with a central straight-throw channel and inclined slots;

a rod accommodated in the central straight-throw channel of the housing;

spring-loaded rams mounted in the inclined slots of the housing, and pushers arranged in the housing and tightened with respect to the housing walls, each rod interacts with the rams through the pushers and the rams of the lower mandrel assemblies are spring-loaded to hold the rams in a working position, the maximum diameter of a circle circumscribed about each mandrel assembly in its working position decreases from the upper assembly to the lower one.

This increases serviceability and reliability of the device in its operation under conditions of a well washing with clay mud, and also in cases of rocks sloughing, since in the process of the device pulling out from the well the mandrel components can move downwards with simultaneous decrease of their maximum diameters.

Another difference of the device is that the pushers are joined with the rams through hinges, and are joined with the rods movable in a radial direction.

This also increases serviceability of the device as provides free, without bends and jamming, movement of the pushers and the rams in the housing.

BRIEF DESCRIPTION OF THE DRAWINGS

So that the invention may be more readily understood, an embodiment of the invention will be further described by way of example, with reference to the accompanying drawings, in which.

DETAILED DESCRIPTION OF THE PREFERRED EMBODIMENT

Figure 1:
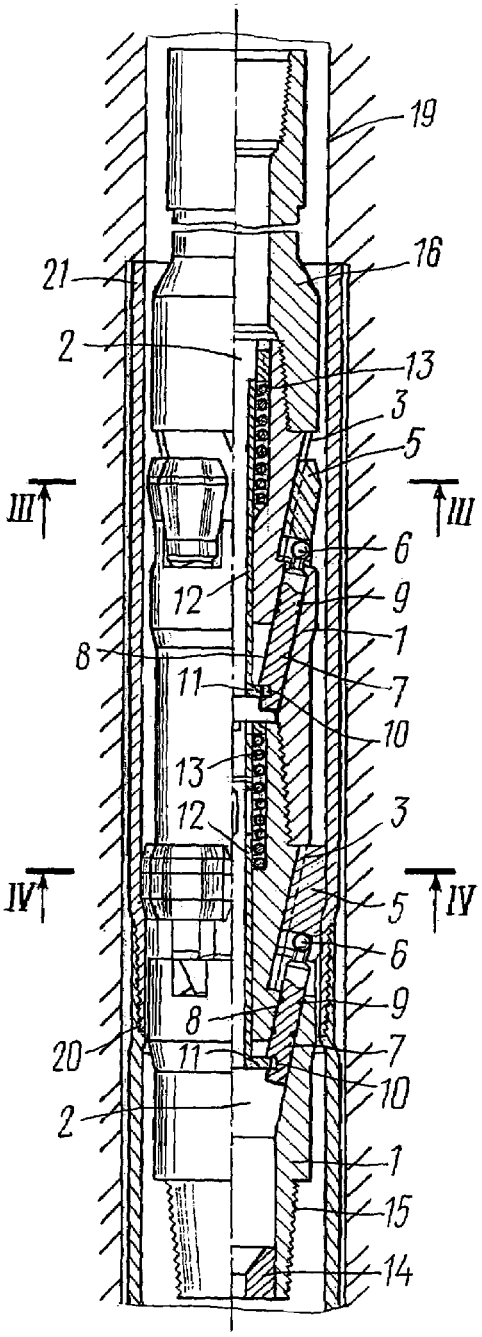
FIG. 1 shows a general view of the device in a longitudinal section.
Figure 3:
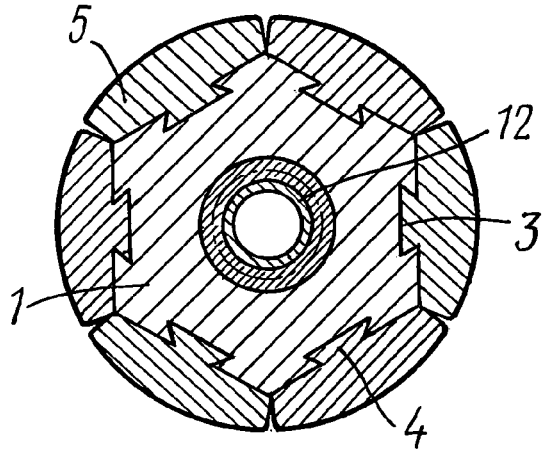
FIG. 3 section III—III in FIG. 1.
Figure 4:
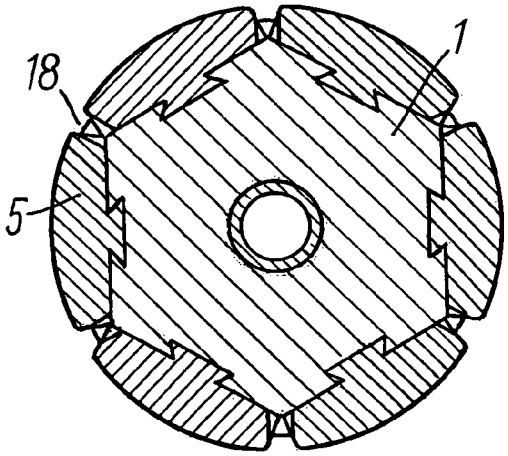
FIG. 4 section IV—IV in FIG. 1.
Figure 5:
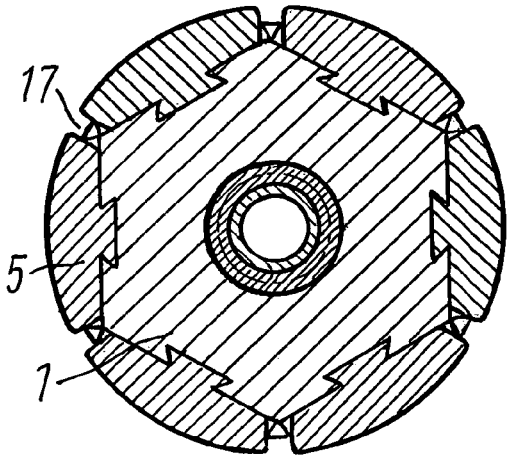
FIG. 5 section V—V in FIG. 2.

A device for installation of a profile liner in a well (FIG. 1) comprises several in-series connected mandrel assemblies, each assembly including a housing 1 provided with a central straight-through channel 2, inclined slots 3 of "dovetail" type 4, (FIGS. 1, 3) and inclined openings 8. In the central channel 2 of the housing 1 there is a rod 12 having a ring shoulder 11, shaped as a ring. Rams 5 are mounted in the inclined slots 3 and pushers 7 are mounted in the openings 8. The pushers 7 are tightened with respect to the housing walls by seals 9. The pushers 7 are provided with radial grooves 10. The rams 5 are connected with the pushers 7 through hinges 6 and with the rod 12 through the shoulder 11 shaped as a ring and made to be fitted into the groove 10. The groove 10 is made to be able to move along the shoulder 11 in a radial direction. Thus the pushers are connected with the rams by hinges with the possibility of swinging The rams 5 of the upper mandrel assemblies are arranged along the perimeter so that in the lower nonoperating position the side surfaces of the rams 5 contact each other (FIG. 3), and in their extension into working position clearances 17 are created between them (FIG. 5). The rams 5 of the lower mandrel assemblies in the original position are extended into working position, therefore there are clearances 18 between them (FIG. 4).

The rods of the upper mandrel assemblies are spring-loaded by springs 13 for holding the rams 5 in the nonoperating position, and of the lower assemblies—for holding the same in the operating position.

Depending on the degree of profile liner expansion (installation in the open hole or inside casing string during its repair) the number of the mandrel assemblies can be increased or decreased, but not less than two. In the lower mandrel component a choke 14 is installed and a thread 15 is made on the housing for connection with downhole equipment (not shown), and a reducer 16 is attached to the housing of the upper mandrel assembly for connection with a drill string (not shown).

Figure 2:
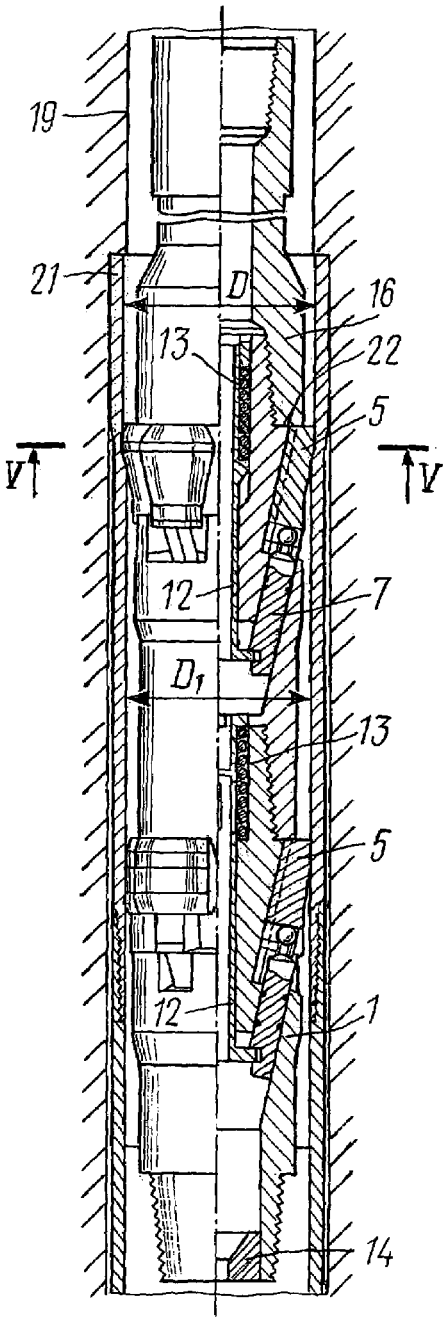
FIG. 2 same, in installating of the liner in a well.

The mandrel assemblies are made so that the maximum diameter of the circle, circumscribed about each mandrel assembly in its working position, is decreasing from the upper assembly to the lower one by the total value, corresponding to the difference between the diameters of circles D and $D_1$ inscribed into the profile liner upon its hydraulic expansion and complete pressing its walls to wellbore walls (FIG. 2).

The device operates in the following way:

The device on a drill string (not shown) is run into a well 19 until the rams 5 of the lower mandrel assembly are against a threaded connection 20 (FIG. 1) of a profile liner 21, expanded preliminarily by hydraulic pressure. Then, producing an axial load the device is forced through the threaded connection 20 (FIG. 2) and raised above it so that the upper mandrel assembly is extended from the liner. Further, by injection of fluid hydraulic pressure is produced in a drill string. Due to the choke 14 presence in the device, a differential pressure is created in it, under which effect the rod 12 of the upper mandrel assemblies together with the pushers 7 and the rams 5 move to the uppermost position until the rams 5 are against an end face 22 of the reducer 16. Here the spring is compressed. Further, by creating an axial load and simultaneous washing out of the well the device is forced through the profile liner 21, as a result profiles of the liner are completely straightened and tightly pressed to the well 19 walls. At the same time calibration of the inside diameter of the profile liner occurs. In this manner all reduced sections of the liner are expanded.

Further, injection of fluid into the well is ceased and the device is pulled out of the well. And the springs 13 return the rams 5 into the original position.

In case of sticking or jamming of the device in a well, the rams 5 of its mandrel assemblies are able to slide down the inclined slots 3 of the housing 1, carrying the rods 12. This allows to avoid emergencies.

Using advantages of mandrelling in expanding profile pipes, such as profile liners, compared with expanding by rollers, the invention allows to increase its serviceability and reliability in installation of liners in wells under clay mud presence and sloughing of rocks.

The invention claimed is:

1. A device for installation of profile liners, the device comprising a plurality of in-series connected mandrel assemblies, including a lower mandrel assembly and an upper mandrel assembly, each of the plurality of mandrel assemblies including: (i) a housing with a central straight-through channel and a plurality of inclined slots, (ii) a rod accommodated in the central straight-through channel of the housing, (iii) a plurality of rams mounted in the inclined slots of the housing, and (iv) a plurality of pushers mounted tightly in the housing, the plurality of pushers being disposed such that the rod interacts with the plurality of rams through the plurality of pushers; wherein the rams of each of the plurality of mandrel assemblies are disposable in either a working position or a non-operating position, the rod of the lower mandrel assembly being spring-loaded to bias the plurality of rams of the lower mandrel assembly to the working position and the rod of the upper mandrel assembly being spring-loaded to bias the plurality of rams of the upper mandrel assembly to the non-operating position, wherein each of the plurality of mandrel assemblies, in its working position, circumscribes a circle having a maximum diameter, the maximum diameter of the circle circumscribed by the upper mandrel assembly being greater than the maximum diameter of the circle circumscribed by the lower mandrel assembly.

2. The device according to claim 1, wherein, in each of the plurality of mandrel assemblies, the plurality of pushers are hingedly joined with the plurality of rams.

3. The device according to claim 2, wherein, in each of the plurality of mandrel assemblies, the rod has a ring shoulder and the plurality of pushers have radial grooves in which the ring shoulder is disposed.

4. A device for installation of profile liners, the device comprising a plurality of in-series connected mandrel assemblies, including a lower mandrel assembly and an upper mandrel assembly, each of the plurality of mandrel assemblies including: (i) a housing with a central straight-through channel and a plurality of inclined slots, (ii) a rod accommodated in the central straight-through channel of the housing, (iii) a plurality of rams mounted in the inclined slots of the housing, and (iv) a plurality of pushers mounted tightly in the housing, the plurality of pushers being disposed such that the rod interacts with the plurality of rams through the plurality of pushers; the rams of each of the plurality of mandrel assemblies being disposable in either a non-operating position wherein the plurality of rams are in contact with one another or a working position wherein the plurality of rams are extended with clearances between the respective rams, the lower mandrel assembly comprising first spring-loading means, comprising a first spring, for biasing the plurality of rams of the lower mandrel assembly to the working position and the upper mandrel assembly comprising second spring-loading means, comprising a second spring, for biasing the plurality of rams of the upper mandrel assembly to the non-operating position, wherein each of the plurality of mandrel assemblies, in its working position, circumscribes a circle having a maximum diameter, the maximum diameter of the circle circumscribed by the upper mandrel assembly being greater than the maximum diameter of the circle circumscribed by the lower mandrel assembly.

5. The device according to claim 4, wherein, in each of the plurality of mandrel assemblies, the rod has a ring shoulder and the plurality of pushers have radial grooves in which the ring shoulder is disposed.

6. The device according to claim 4, wherein, in each of the plurality of mandrel assemblies, the plurality of pushers are hingedly joined with the plurality of rams.

7. A method for expansion of a profile liner in a well, comprising:

(a) providing the device of claim 1;

(b) lowering the device into the well until the rams of the lower mandrel assembly are disposed against a threaded connection of the profile liner;

(c) forcing the device through the threaded connection to cause expansion of the threaded connection;

(d) raising the device and causing the plurality of rams of the upper mandrel assembly to extend to the working position; and (e) forcing the device through the profile liner.

8. A method for expansion of a profile liner in a well, comprising:

(a) providing the device of claim 4;

(b) lowering the device into the well until the rams of the lower mandrel assembly are disposed against a threaded connection of the profile liner;

(c) forcing the device through the threaded connection to cause expansion of the threaded connection;

(d) raising the device and causing the second spring of the second spring-loading means to compress so that the plurality of rams of the upper mandrel assembly extend to the working position; and (e) forcing the device through the profile liner.

9. A method for expansion of a profile liner in a well, comprising:

(a) providing the device of claim 5;

(b) lowering the device into the well until the rams of the lower mandrel assembly are disposed against a threaded connection of the profile liner;

(c) forcing the device through the threaded connection to cause expansion of the threaded connection;

(d) raising the device and causing the second spring of the second spring-loading means to compress so that the plurality of rams of the upper mandrel assembly extend to the working position; and (e) forcing the device through the profile liner.

10. A method for expansion of a profile liner in a well, comprising:

(a) providing the device of claim 6;

(b) lowering the device into the well until the rams of the lower mandrel assembly are disposed against a threaded connection of the profile liner;

(c) forcing the device through the threaded connection to cause expansion of the threaded connection;

(d) raising the device and causing the second spring of the second spring-loading means to compress so that the plurality of rams of the upper mandrel assembly extend to the working position; and (e) forcing the device through the profile liner.

* * * * *